United States Patent [19]

Gendron

[11] 4,238,166

[45] Dec. 9, 1980

[54] UNDERWATER DRIVING OF PILES

[75] Inventor: George J. Gendron, Houston, Tex.

[73] Assignee: Raymond International Builders, Inc., Houston, Tex.

[21] Appl. No.: 894,601

[22] Filed: Apr. 7, 1978

[51] Int. Cl.[3] ..... E02D 7/10; B25D 9/00

[52] U.S. Cl. ..... 405/228; 405/232; 173/DIG. 1

[58] Field of Search ..... 405/227, 228, 232, 208; 173/134, 135, 127, DIG. 1, 128, 132, 137

[56] References Cited

U.S. PATENT DOCUMENTS

| | | | |
|---|---|---|---|
| 1,094,949 | 4/1914 | Taft | 405/228 |
| 1,908,217 | 5/1933 | Blumenthal . | |
| 2,521,976 | 9/1950 | Hays . | |
| 2,723,532 | 11/1955 | Smith . | |
| 3,367,426 | 2/1968 | Laverty . | |
| 3,502,159 | 3/1970 | Pogonowski . | |
| 3,604,522 | 9/1971 | Doughty . | |
| 3,646,598 | 2/1972 | Chelminski . | |
| 3,751,930 | 8/1973 | Mott et al. . | |
| 3,815,371 | 6/1974 | Koehler . | |
| 3,817,335 | 6/1974 | Chelminski | 173/127 |
| 3,991,581 | 11/1976 | Kolb | 405/227 |
| 4,033,139 | 7/1977 | Frederick . | |
| 4,060,139 | 11/1977 | Adair | 173/DIG. 1 |
| 4,080,795 | 3/1978 | Weidler | 405/227 |
| 4,126,191 | 11/1978 | Gendron et al. | 173/DIG. 1 |
| 4,138,199 | 2/1979 | Gendron et al. | 405/232 |

*Primary Examiner*—Dennis L. Taylor

*Attorney, Agent, or Firm*—Fitzpatrick, Cella, Harper & Scinto

[57] ABSTRACT

Piles are driven underwater by feeding them through spaced apart, aligned, tubular guides mounted on a structure to be anchored by the piles. When the piles reach the sea bed an elongated follower is fed down through the guide sleeves to the top of the piles. A compressible fluid driven hammer is arranged to drive against the upper end of the follower which in turn drives the pile. The submerged depth of the hammer at the upper end of the follower is less than it would be at the top of the pile and accordingly the exhaust pressure at the hammer is minimized and the hammer effectiveness is enhanced.

10 Claims, 10 Drawing Figures

50
54
58
38
30
40
42
34
36
12

UNDERWATER DRIVING OF PILES

BACKGROUND OF THE INVENTION

1. Field of the Invention

This invention relates to the driving of piles into a sea bed and more particularly it concerns novel methods and apparatus for efficiently driving piles underwater with expansible gas driven hammers.

2. Description of the Prior Art

The present invention is particularly suitable for driving piles into sea beds located at large water depths, e.g. five hundred feet (150 meters) or more. With the advent of large offshore towers used to drill for and extract oil and other minerals from the sea bed at offshore locations, it has become necessary to develop ways to drive piles at such depths to anchor the base of the tower securely in place.

One technique used in the past for driving piles into the sea bed involved the provision of an elongated mandrel which extended from the upper end of the pile, at some location under water, to a location up above the water surface. A suitable derrick or crane would support a hammer on top of the mandrel and the hammer would drive the mandrel, and the pile, downwardly into the sea bed. This technique was not suitable for large water depths because the required mandrel length was too great to be handled effectively with available equipment. Also the ability of the mandrel to transmit the hammer blows down to the pile diminished as the mandrel length increased.

Hydraulically driven hammers have been developed which can be operated under water and directly on the pile itself thus eliminating the need for a mandrel. These hydraulic hammers however require complex auxiliary equipment due to the fact that their working fluid is maintained in a closed system. These hydraulic hammers also required special seals and great care had to be taken to insure against leakage of the hydraulic fluid.

Compressible fluid driven hammers have also been developed for underwater operations, one example being shown in U.S. Pat. No. 4,060,139. These compressible fluid hammers are driven by means of a compressed gas, such as air; and they can exhaust into the surrounding sea without contamination. Because of this, no recirculation circuit or special fluid seals are required in connection with these compressible fluid hammers. While compressible fluid driven hammers have provided a considerable improvement over hydraulically driven hammers in underwater pile driving operations, it has been found that when these hammers are used at large depths, i.e. in excess of three hundred feet (90 meters), their efficiency diminishes appreciably.

In copending U.S. applications Ser. No. 743,227 filed Nov. 19, 1976 now U.S. Pat. No. 4,154,307, issued May 15, 1979, and Ser. No. 743,327 filed Nov. 19, 1976, now U.S. Pat. No. 4,138,199, issued Feb. 6, 1979, there are described novel arrangements for utilizing underwater hammers to drive piles which anchor an offshore tower or jacket structure to the sea bed. According to those applications, a plurality of spaced apart guide sleeves are mounted along the legs of the tower or jacket in alignment with each other and these guide sleeves serve to guide the anchoring piles down to precise locations on the sea bed. In addition, the underwater hammer is provided inside an elongated housing which in turn is fed down through and is guided by the guide sleeves onto the top of the pile. The guide sleeves thus not only guide and support the piles for accurate driving, but they also, in combination with the elongated housing, position the hammer on top of the pile.

SUMMARY OF THE INVENTION

The present invention provides improvements over the prior art. More specifically the present invention makes possible the efficient driving of piles at great water depths with a compressible fluid driven underwater hammer for the anchoring of offshore structures.

According to one aspect of the present invention, a plurality of spaced apart guide sleeves are mounted in alignment on the structure for guiding a pile to be driven down to the sea bed. An elongated follower is also arranged to be guided down through the sleeves and onto the top of the pile. A compressible fluid driven hammer, which exhausts into the surrounding water, is also arranged to be positioned on the upper end of the follower to hammer it and drive it downwardly on the pile to drive the pile into the sea bed. The follower has sufficient length so that the water pressure in the vicinity of the hammer is significantly less than the pressure at the top of the pile. Thus the hammer operates more effectively at the top of the follower than it would if it were acting directly on the pile. Although a finite amount of driving energy is lost in transmission through the follower, this loss is more than compensated by the increased effectiveness of hammer operation at the shallower depth permitted by the use of the follower assembly.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification wherein.

DETAILED DESCRIPTION OF THE PREFERRED EMBODIMENT

Figure 1:
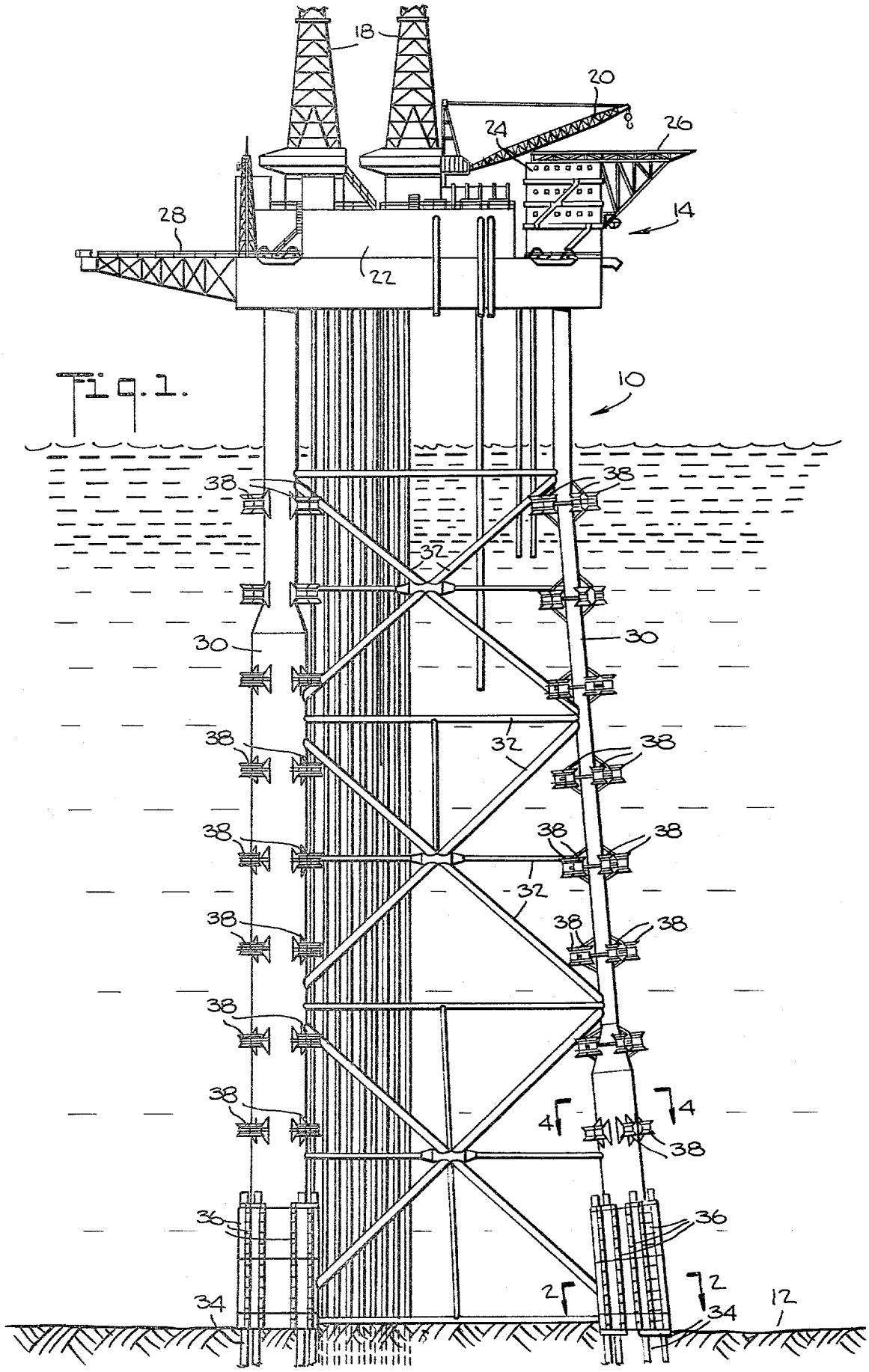
FIG. 1 is an elevational view of an offshore tower which may be anchored to a sea bed by means of the present invention.

The offshore tower of FIG. 1 comprises an open framework support structure 10, known as a template, which rests on and is anchored to the sea bed 12 and which supports a platform structure 14 up above the sea surface 16.

The platform structure 14 is outfitted according to the nature of the work to be performed, e.g. exploration, drilling or production of resources from the sea bed 12 or from below the sea bed. Thus, where as shown, the platform is to be used for oil well drilling, it will be equipped with such facilities as drilling towers 18, one or more cranes 20, storage facilities 22, crew quarters 24, a helicopter pad 26, a flare boom 28, etc.

The platform structure 14 is mounted on legs 30 of the support structure 10 a sufficient distance above the sea surface 16 so as not to be affected by waves or tides. Thus the platform structure 14 may be held at an elevation as much as seventy five feet (23 meters) above mean water level.

The legs 30 of the support structure are interconnected by diagonal and transverse spars 32 which provide strength and rigidity while permitting water to flow freely through and past the support structure. This enables the support structure to withstand water currents caused by tides, winds, etc.

The bottom of the support structure 10 is anchored to the sea bed 12 by means of anchor piles 34 arranged in arrays around the lower end of each of the legs 30. These anchor piles, which may be two hundred fifty feet in length (76 meters) extend through tubular sleeves 36 attached to the legs 30 and down into the sea bed 12 to depths which may be as great as two hundred feet below the sea surface. The particular depth to which the piles must be driven will, of course, depend upon the firmness of the sea bed and the size and weight of the offshore tower structure. The sleeves 36 are slightly larger in diameter than the piles 34 and after the piles are driven the annular space between the upper region of each pile and the surrounding sleeve is filled with cement grout which hardens and bonds the driver pile to the sleeve and thus to the support structure.

Figure 2:
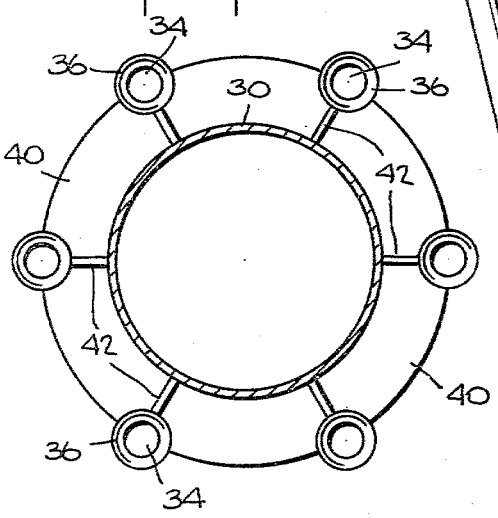
FIG. 2 is an enlarged cross sectional view taken along line 2—2 of FIG. 1.

Each of the support structure legs 30 has mounted thereon, at various levels, an array of tubular guides 38. These guides are arranged in longitudinal alignment with the sleeves 36 and as shown in FIGS. 1 and 2 they are held in position by means of horizontal and vertical braces 40 and 42 welded to the legs 30. The guides 38 are of the same diameter as the sleeves 36 and they guide the piles 34 down into the sleeves.

Figure 3:
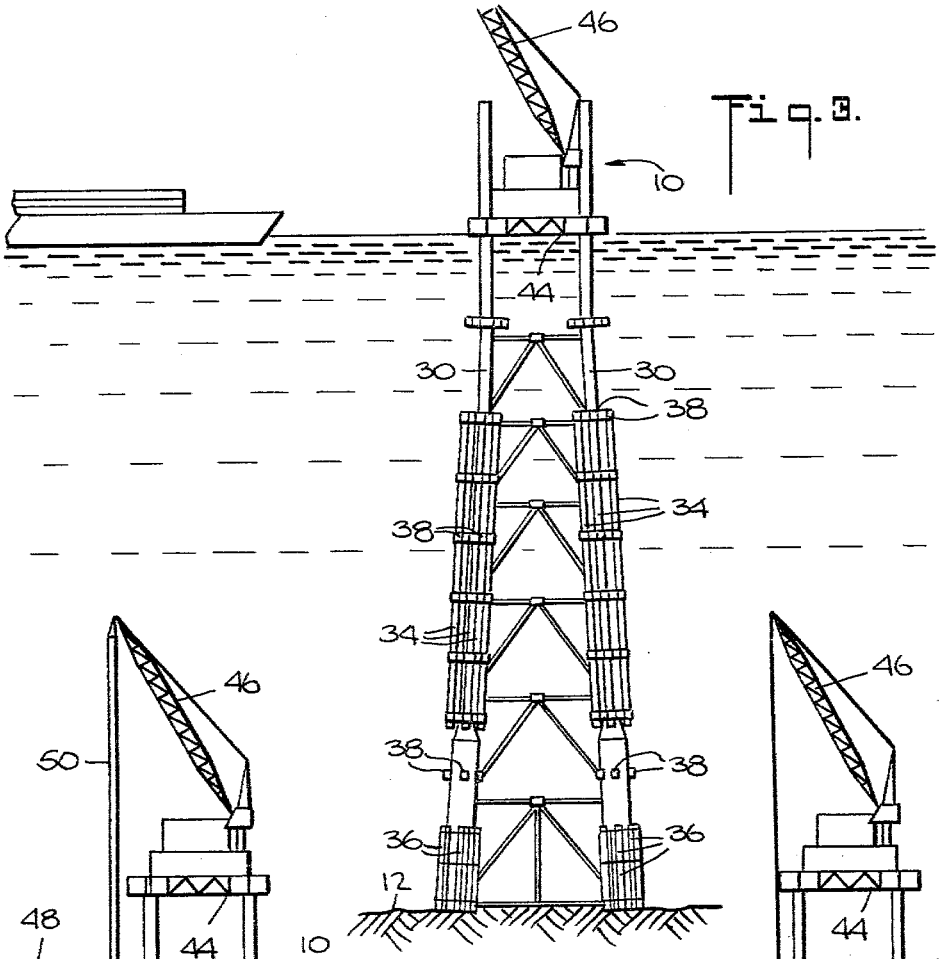
FIG. 3 is an elevational view showing a first step in the anchoring of the tower of FIG. 1.
Figure 4:
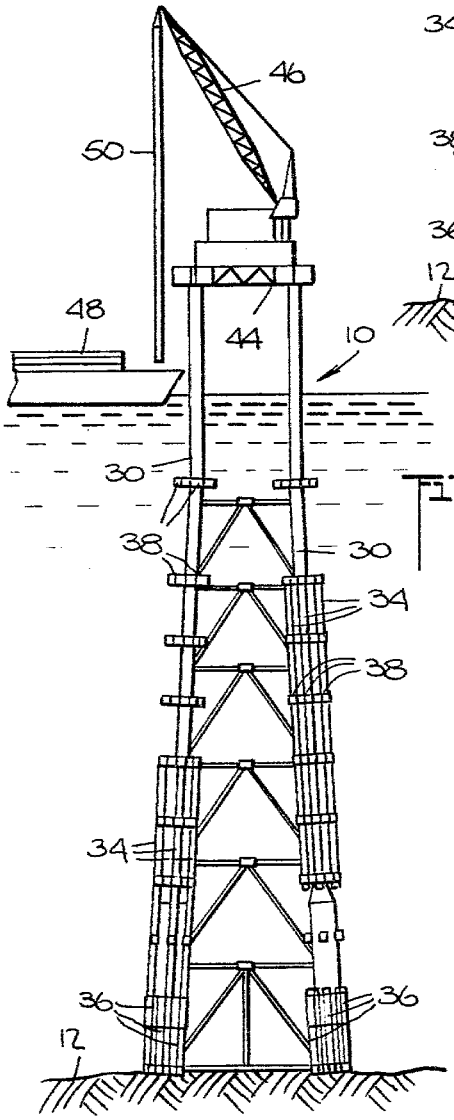
FIG. 4 is an elevational view showing a second step in the anchoring of the tower of FIG. 1.
Figure 5:
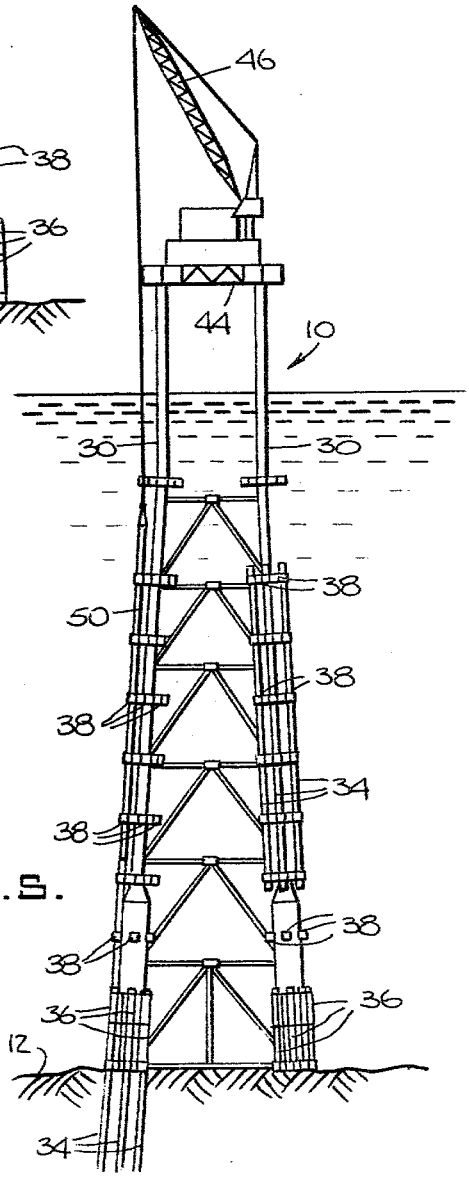
FIG. 5 is an elevational view showing a third step in the anchoring of the tower of FIG. 1.

FIGS. 3–5 illustrate the general technique for anchoring the support structure 10. As shown in FIG. 3 the support structure is first set on the sea bed 12 in upright position at a desired location. The support structure may first be floated and towed to location and then submerged, under controlled conditions according to known techniques, until it comes to rest in upright position as shown in FIG. 3. The anchor piles 34 as shown, may be threaded into the guides 38 and held in place alongside the legs 30 while the support structure is being set into position. Thereafter the piles may be releases so that, as shown in FIG. 4, they will pass down through the guides 38 and will be guided by them into the sleeves 36.

While the support structure 10 is resting on the sea bed 12 as shown in FIGS. 3 and 4, a working barge 44 is floated into position adjacent the legs 30 and is then lifted up on the legs by suitable jacking means. The details of this operation are described in U.S. Pat. No. 3,857,247. The working barge 44 is substantially smaller and lighter than the platform structure 14 and it does not appreciably affect the stability of the yet unanchored support structure. The working barge 44, however, does have the capacity to support a hammer handling crane 46 and other equipment needed to drive and secure the piles 34.

As shown in FIG. 4 the crane 46 may be used to lift supplies up off a supply vessel 48 and up onto the elevated barge 44. The crane 46 also lifts an elongated hammer-follower assembly 50 by one end and brings it into position over one of the uppermost set of tubular guides 38. The hammer-follower assembly is then lowered and is guided down through the guides 38 until it comes to rest on top of one of the piles 34 as shown in FIG. 5. The hammer-follower assembly 50 is of sufficiently small diameter to fit easily through the guides 38 and it is long enough to extend over the distance spanning three adjacent sets of the guides. This ensures that as the hammer-follower assembly 50 is lowered it will always be engaged by at least two sets of the guides 38 and will be directed by them into the next lower set and ultimately will be positioned on top of one of the piles 34.

When the hammer-follower assembly 50 is positioned on top of a pile 34, it is put into operation and acts to drive the pile 34 downwardly into the sea bed 12. As this driving takes place, the hammer-follower assembly 50 follows the pile 34 downwardly until the pile has penetrated a predetermined distance into the sea bed 12, with the upper end of the pile extending up through the sleeve 36. The hammer-follower assembly 50 is then lifted back up through the guides 38 and is thereafter lowered back down through different guides of each set to drive another pile. When the piles 34 have been driven they are locked to the sleeves 36 by wedges, as described in U.S. patent application Ser. No. 759,028 filed Jan. 13, 1977, now U.S. Pat. No. 4,102,143 issued July 25, 1978 or they may be sealed to the sleeves by a layer of grout pumped into the annular space between the pile and the sleeve.

Figures 6, 7, 8:
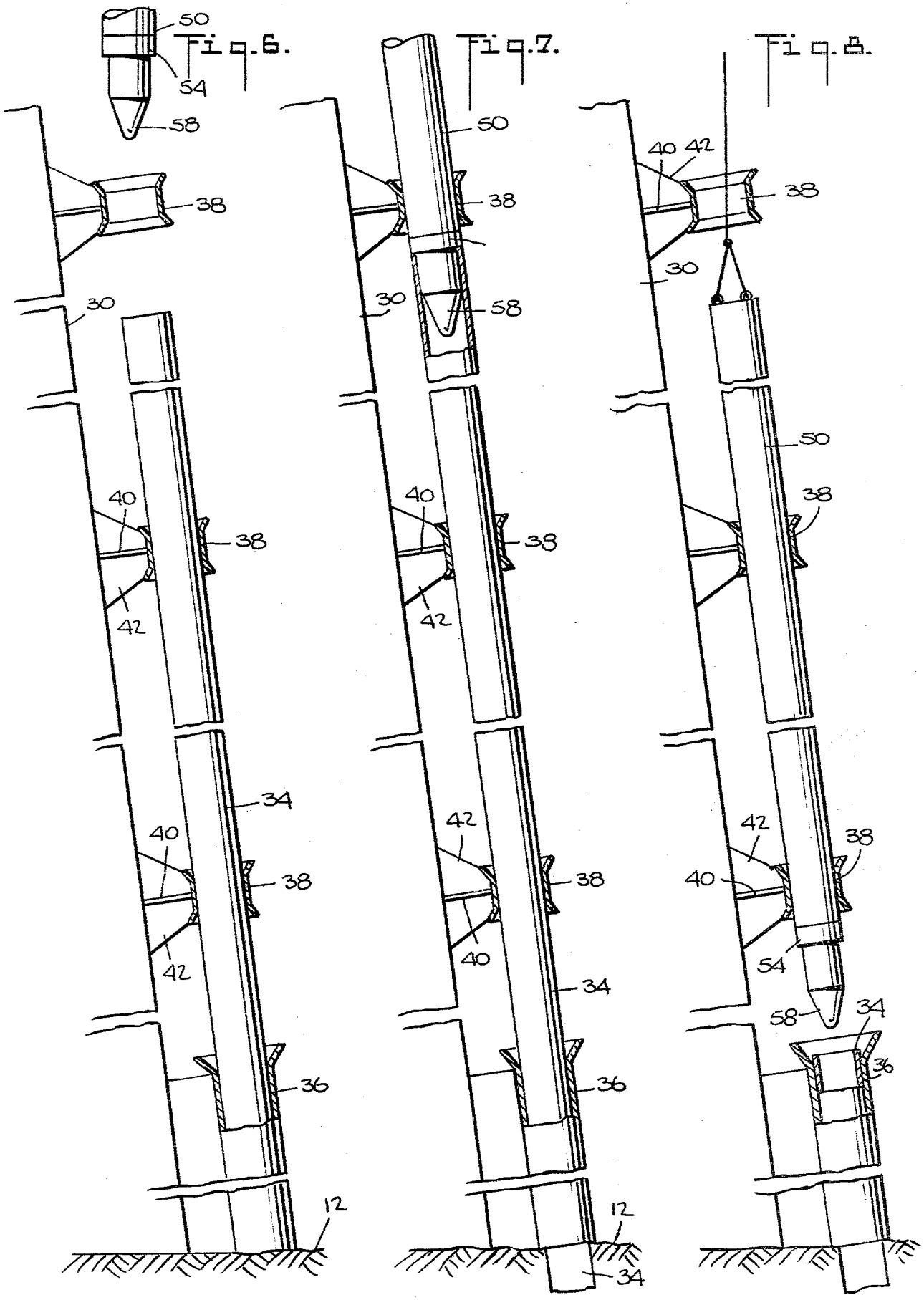
FIGS. 6–8 are fragmentary elevational views illustrating the sequence of engaging and driving a pile alongside a leg of the tower of FIG. 1.

FIGS. 6–8 illustrate how the guides 38 along the legs 30 serve to position and align both the piles 34 and the hammer-follower assembly 50. As shown in FIG. 6, a pile 34 has been released and allowed to pass downwardly through the guides 38 and into an associated sleeve 36 near the bottom of the support structure leg 30. The lower end of the hammer-follower assembly 50 is then lowered down through the uppermost of the guides 38 and is positioned and aligned by these guides along the path of the pile 34 so that, as shown in FIG. 7, the hammer-follower assembly is automatically guided into hammering engagement with the upper end of the pile. Thereafter, as shown in FIG. 8, the hammer-follower 50 drives the pile 34 downwardly while it continues to be guided by the guides 38 to follow the pile in proper alignment therewith. It will be appreciated that in order to guide the hammer-follower 50 in the manner described, the sets of guides 38 must be positioned close enough to each other to enable the hammer-follower 50 to span the spaces between two adjacent sets. That is the hammer-follower 50 should at all times be engaged by at least two of the guides 38.

Figure 9:
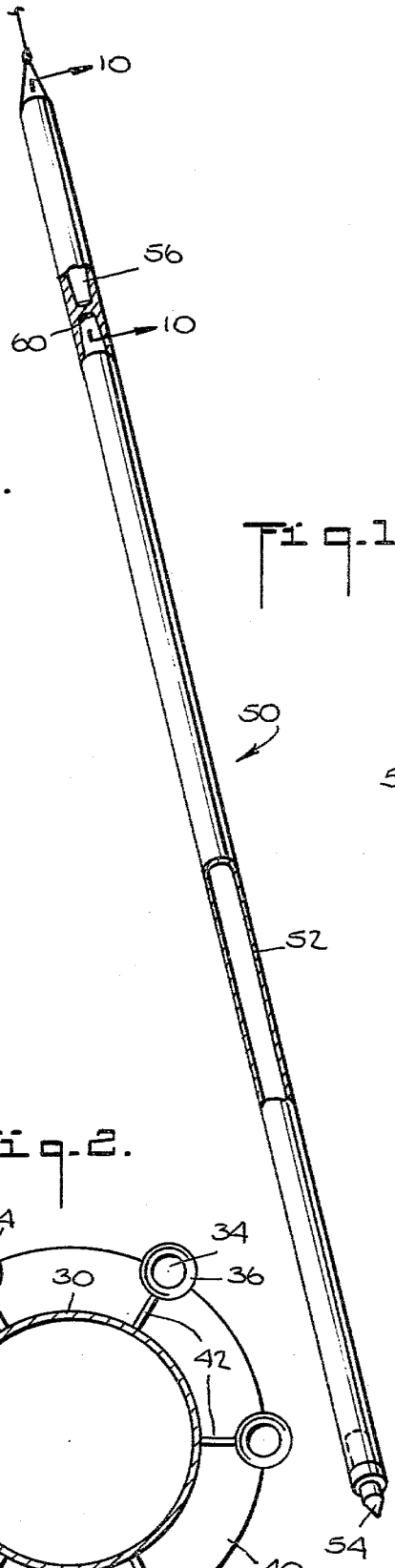
FIG. 9 is a perspective view, partially cut away, of a hammer and follower assembly used in carrying out the present invention.
Figure 10:
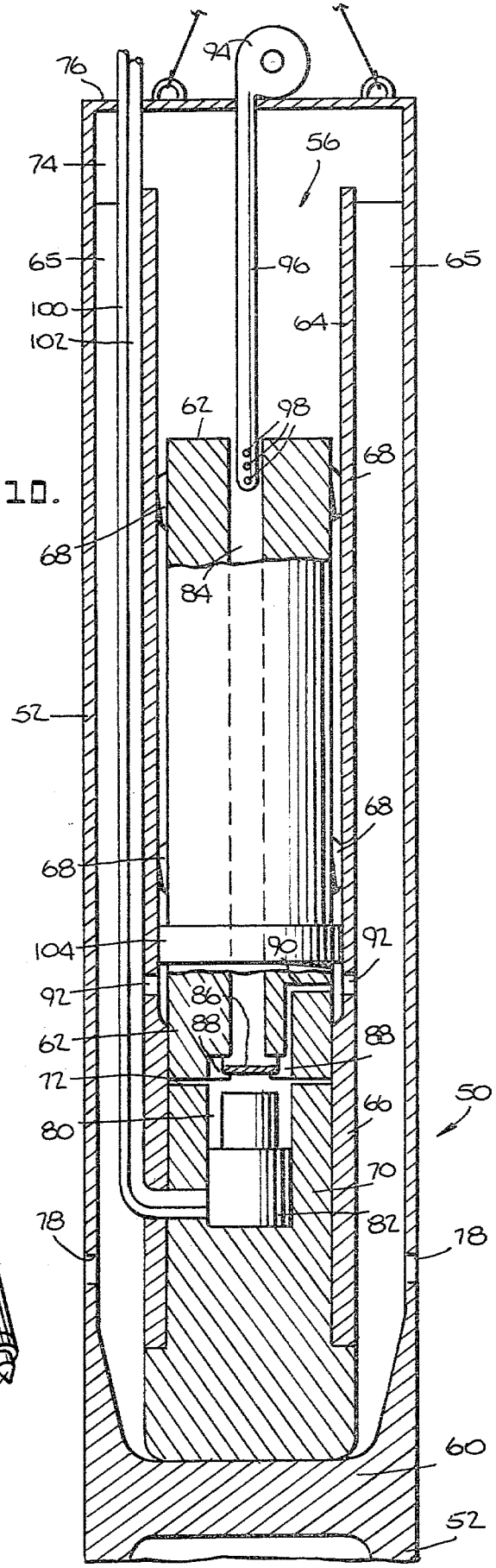
FIG. 10 is an enlarged section view taken along line 10—10 of FIG. 9.

The hammer-follower assembly 50 is shown in greater detail in FIGS. 9 and 10. As can be seen in FIG. 9, the hammer-follower assembly is made up of an elongated heavy wall pipe 52 with a driving collar 54 fitted to its lower end and an underwater hammer assembly 56 arranged inside its upper end.

The driving collar 54 includes an alignment point 58 on the end thereof which fits into the upper end of the pile 34 so that the collar rests on the upper edge of the pile when the hammer-follower is in operation. As can be seen in FIG. 9, the hammer assembly 56 is arranged to hammer on a transverse wall 60 near the upper end of the pipe 52 and the hammer blows are transmitted down along the pipe wall to the collar 54 and from there to the upper end of the pile 34.

The hammer assembly 56 is shown in some detail in FIG. 10. This hammer assembly may be of the same construction as that shown and described in copending U.S. application Ser. No. 803,302 filed June 3, 1977. As shown, the hammer assembly 56 includes a massive cylindrically shaped ram 62 arranged for free up and down movement in a guide tube 64. The lower end of the guide tube is of smaller inner diameter than the remainder thereof and this forms an acceleration sleeve 66 which fits closely around the lower end of the ram 62 when it is in its lowermost position as shown in FIG. 10. The upper portion of the ram is provided with sliding shoes 68 which guide it in the guide tube 64. An anvil 70 is positioned at the lower end of the guide tube 64 and it fits part way up into the acceleration sleeve 66. The anvil 70 has an impact face 72 which is impacted by the lower end of the ram 62 when it falls downwardly inside the guide tube 64. The anvil transfers the energy of these impacts down to the transverse wall 60 and the wall of the pipe 52 to the collar 54 and the pile 34.

The upper end to the pipe 52 surrounds the guide tube 64 and forms an outer cylindrical casing 74. This casing is closed at the top by a cover plate 76 a short distance above the guide tube 64. Spacer ribs 65 extend radially between the guide tube 64 and the outer casing 74 to hold the tube centered within the casing. As shown the upper end of the guide tube 64 is located below the cover plate 76 so that the interior of the guide tube above the ram 62 is in open communication with the spaces between the guide tube and outer casing. The outer casing 74 is provided with exhaust openings 78 below the upper end of the acceleration sleeve 66. These openings 78 place the lower region around the guide tube 64 into open communication with the surrounding sea water.

The anvil 70 is formed with a gas discharge device cavity 80 which opens to the impact face 72 and which contains a gas discharge device 82. The cavity 80 is defined by and between the anvil 70 and the ram 62. The details of the gas discharge device form no part of the present invention and therefore they will not be described herein. Suitable such devices are described in detail in U.S. Pat. No. 3,310,128; No. 3,379,273; No. 3,817,335; No. 3,892,279 and No. 3,958,647. The gas discharge device 82 accumulates a charge of gas, such as air, nitrogen, etc. at a very high pressure; and then, when its gas charge reaches a predetermined pressure, the device is automatically triggered and releases its charge into the surrounding cavity 80.

The ram 62 is formed with an axial reflood passageway 84 which opens at the upper and lower ends of the ram. A reflood valve plate 86 is mounted by means of retainer lugs 88 at the bottom of the ram 62 for up and down movement to close and open the lower end of the reflood passageway 84. A reflood vent passageway 90 extends through the lower portion of the ram 62 with its lower end exposed to the cavity 80 and its upper end open at the side of the ram above the guide tube acceleration sleeve 66 when the ram is at rest on the anvil 70 as shown in FIG. 10.

The guide tube 64 is also provided with guide tube ports 92 just above the acceleration sleeve 66. As shown, these ports communicate with the space between the guide tube 64 and the outer casing 74.

A reflood pump 94 is mounted on top of the casing cover plate 76. The outlet of this pump is connected to a reflood tube 96 which extends down through the cover plate 76 and part way into the reflood passageway 84 of the ram 62. The reflood tube 96 is of sufficient length to just enter the top of the reflood passageway when the ram is at rest on the anvil 70 as shown in FIG. 10. A plurality of reflood tube outlet openings 98 are provided along the sides of the reflood tube 96 at its lower end so that water which is pumped down through the tube is directed into the reflood passageway.

The reflood pump 94 is driven continuously and any suitable driving means, such as an electric motor (not shown) may be provided for this purpose. The inlet of the reflood pump 96 is arranged to take in water from the region adjacent the hammer assembly 56 and to pump it down through the reflood tube 96. The inlet is preferably arranged to be located away from the path of gas bubbles which may emanate from the hammer so that nonaerated water will be pumped into the reflood passageway. It will also be appreciated that the pump 94 may be mounted at or above the water surface with its outlet connected via a suitable conduit (not shown) extending down to the reflood tube 96.

Electrical cables 100 and a pressurized gas supply conduit 102 pass down through the casing cover plate 76 and extend down through the space between the guide tube 64 and the outer casing 74 to the lower end of the hammer. External means, not shown, are provided to force pressurized air or gas down through the conduit 102 to the gas discharge device 82. The electrical cables 100 are used to transmit instrumentation signals back to the surface.

The ram 62 is also fitted with a circumferential ram to guide tube sliding seal 104, which when the ram is at rest on the anvil 70, as shown in FIG. 10, is positioned above the guide tube ports 92.

In operation, the hammer assembly 56 becomes submerged when, as shown in FIG. 5, the hammer-follower assembly 50 is lowered down to the anchor pile 34 to be driven. Air or other gas is trapped inside the outer casing 74 (FIG. 10). This gas becomes compressed therein to the pressure of the surrounding water which acts through the exhaust openings 78. It will be appreciated that the outer casing 74 functions in the manner of a diving bell in that the air or gas trapped inside it prevents water from entering up past the level of the anvil 70. Thus the internal moving portions of the hammer are maintained essentially free of water. When the hammer is first lowered into the water, the air or gas pressure inside the outer casing 74 may not be sufficient to prevent water from entering up into the hammer. However, during operation of the hammer exhaust gas from the discharge device 82 pressurizes the interior of the outer casing 74 and keeps it free of water.

The hammer operates by intermittent triggering of the gas discharge device 82 which, upon each triggering, releases a sudden burst of pressurized gas into the cavity 80 to drive the ram 62 upwardly in the guide tube 64. The ram thereafter falls back down in the tube and strikes the anvil 70 to deliver an impact blow through the anvil and the transverse wall 60 down through the pipe 52 to the pile being driven. After each triggering of the gas discharge device 82 a further charge of pressurized gas is supplied to it through the pressurized gas supply conduit 102.

When the ram 62 is at rest on the anvil 70 awaiting triggering of the gas discharge device 64, as shown in FIG. 10, the reflood pump 94 pumps surrounding water down through the reflood tube 96 and out the openings 98 into the reflood passageway 84. This water flows down through the reflood passageway 84 past the valve plate 86 and into the cavity 80 to flood the cavity. Air or other gas from the cavity is vented through the reflood vent passage 90 and out through the guide tube ports 92 to the space between the guide tube 64 and the outer casing 74. This displaced air pushes out against the water level present at the exhaust openings 78.

When the gas discharge device 82 is triggered, the resulting blast of pressurized gas forces the reflood valve plate 86 against the bottom of the reflood passageway 84 to close it against further flow. Nearly the entire energy of the expanding gas from the gas discharge device is then directed against the bottom of the ram 62 to drive it upwardly in the guide tube 64.

Shortly after the ram 62 has begun its upward movement, but after most of the driving energy of the released gas from the discharge device 82 has been expended, the lower end of the ram 62 clears the acceleration sleeve 66 and the guide tube ports 92. When this occurs the water and excess air present in the cavity 80 are driven outwardly through the ports and into the region between the guide tube 64 and the outer casing 74.

The ram 62 then continues its upward movement in the guide tube 64 until the kinetic energy it received from the expanding gas has been dissipated. The ram then falls back down through the guide tube until it strikes the anvil 70 and comes to rest thereon.

During the up and down movement of the ram 62 the space between the guide tube 64 and the outer casing 74 is in communication with the region above the ram by virtue of the fact that the upper end of the guide tube 64 is located below the casing cover plate 76. The space between the guide tube and the outer casing is also in communication with the region below the ram via the guide tube ports 92. This allows for free circulation of air or gas displaced by the ram during the major portion of its up and down movement. As a result no vacuum is drawn under the ram during its upward stroke so that the chances of water being drawn in to flood the anvil region prematurely are minimized. Further, during the downward ram stroke no gas becomes trapped under the ram until shortly before it reaches the anvil, i.e. when it reenters the acceleration sleeve 66. Consequently, cushioning by entrapment of gas under the ram is minimized, and a sharp ram to anvil impact is obtained.

When the gas discharge device 82 is triggered and the reflood valve plate 86 closes the reflood passageway 84, the water trapped inside the passageway is driven upwardly as though it were an integral part of the ram 62. After the ram reaches the top of its stroke and begins to fall back downwardly the water in the passageway 84 also falls back downwardly so that it produces no net change on the valve plate and does not cause the plate to open. Thus no reflooding of the cavity 80 takes place due to the water trapped in the reflood passageway 84.

It will be appreciated from the foregoing that the hammer exhausts through the exhaust openings 78 against the pressure of the surrounding water. It has been found that even though the surrounding water pressure, and corresponding hammer exhaust pressure, increases only linearly with increasing water depth, the resulting decrease in the conversion of input gas pressure energy to kinetic ram energy is exponentially related to water depth. Thus while the pressurized gas discharge hammer is well suited for operating in a submerged condition its effectiveness is very significantly affected at substantial water depths.

The arrangement of the present invention, however, permits the effective operation of a pressurized gas discharge hammer for driving piles at large water depths. This is because the hammer assembly 56 is arranged at the upper end of the hammer-follower assembly 50 and the hammer-follower assembly is used, not only to guide the hammer assembly into position over each pile to be driven, but also to transmit the hammer blows down to the pile itself. The hammer assembly, in turn, being located at the upper end of the hammer-follower assembly is subjected to substantially less pressure than it would be if it were positioned directly on top of the pile being driven.

Although some energy losses are encountered in the transmission of hammer blow energy through the follower pipe 52, these losses are substantially more than overcome by the increased effectiveness of the low pressure environment of the hammer operating under conditions of low pressure at shallow depths.

By way of example, in conducting pile driving operations at water depths of five hundred feet (152 meters) a hammer-follower assembly length of two hundred feet (61 meters) is contemplated. This serves to reduce the hammer exhaust pressure by nearly ninety pounds per square inch (6.3 $Kg/cm^2$) in sea water. It will, of course, be appreciated that with longer hammer-follower assemblies greater reductions in exhaust pressure can be achieved. Further, as driving takes place at greater water depths, the relative increase in hammering effectiveness is even further increased by the present invention.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. In a method of anchoring to a sea bed an elongated structure which extends upwardly from the sea bed to a location above the surface of the sea, the steps of guiding an elongated anchor pile down through spaced apart tubular guides, arranged along the length of said structure below the surface of the sea, until the pile reaches the sea bed, lowering an elongated follower assembly down through said tubular guides and into contact with the upper end of the pile, the upper end of said follower assembly being submerged but being located at a depth such that the surrounding water pressure at said upper end is substantially less than the water pressure at the upper end of the pile, operating an underwater hammer provided at the upper end of said follower assembly and in open fluid communication with said surrounding water to apply downwardly driving hammer blows to the upper end of said follower assembly and to exhaust against the pressure of said surrounding water, and transmitting said hammer blows through said follower assembly down to said pile.

2. A method according to claim 1 wherein said underwater hammer is maintained inside the upper end of said follower assembly.

3. A method according to claim 1 wherein said hammer and follower assembly are lowered during said operating of said hammer to maintain driving contact with the upper end of said pile as it is driven downwardly.

4. A method according to claim 3 wherein said follower is guided by said guides while it is being lowered.

5. Apparatus for use in driving piles underwater, said apparatus comprising an elongated structure extending upwardly from a sea bottom to a location above the surface of the sea, a plurality of spaced apart guide sleeves mounted on said elongated structure below the surface of the sea in mutual alignment for guiding a pile inserted from above the surface down to a predetermined location on the sea bottom, a pile inserted in said guide sleeves and resting on the sea bottom, an elongated follower fitted to slide through said guide sleeves to be guided thereby with its lower end resting on the top of said pile, said follower being capable of transmitting hammer blows applied to the upper end thereof to said pile, the upper end of said follower being submerged but being located at a depth such that the surrounding water pressure at said upper end is substantially less than the water pressure at the top of said pile, and an underwater hammer of the type which is driven by an expandable fluid, said hammer being positioned and arranged to hammer against the upper end of said follower, under the surface of the sea, said hammer having a driving fluid exhaust in open communication with the ambient water pressure surrounding said hammer.

6. Apparatus according to claim 5 wherein said follower comprises a hollow tubular member having a driving collar at its lower end.

7. Apparatus according to claim 5 wherein said follower is formed with a transverse inner wall near its upper end and wherein said hammer is positioned inside said follower above said transverse wall to hammer against said wall.

8. Apparatus according to claim 5 wherein the upper end of said follower is closed and wherein said follower is provided with exhaust openings a short distance above said transverse wall.

9. Apparatus according to claim 5 wherein said follower has a length of at least two hundred feet.

10. Apparatus according to claim 5 wherein said guides are spaced apart from each other by an amount such that said follower is at all times engaged by at least two of said guides.

* * * * *